US011837201B2

(12) United States Patent
Swope

(10) Patent No.: US 11,837,201 B2
(45) Date of Patent: Dec. 5, 2023

(54) ADJUSTABLE BRIDGE FOR STRINGED INSTRUMENT DEVICE AND METHOD

(71) Applicant: Christopher Clay Swope, Overland Park, KS (US)

(72) Inventor: Christopher Clay Swope, Overland Park, KS (US)

( * ) Notice: Subject to any disclaimer, the term of this patent is extended or adjusted under 35 U.S.C. 154(b) by 122 days.

(21) Appl. No.: 17/488,970

(22) Filed: Sep. 29, 2021

(65) Prior Publication Data

US 2022/0101816 A1 Mar. 31, 2022

Related U.S. Application Data

(60) Provisional application No. 63/085,245, filed on Sep. 30, 2020.

(51) Int. Cl.
*G10D 3/04* (2020.01)

(52) U.S. Cl.
CPC ..... *G10D 3/04* (2013.01)

(58) Field of Classification Search
CPC ..... G10D 3/04; G10D 1/085; G10D 3/00; G10D 1/00
See application file for complete search history.

(56) References Cited

U.S. PATENT DOCUMENTS

| | | | | |
|---|---|---|---|---|
| 2,972,923 | A | 2/1961 | Fender | |
| 3,241,418 | A | 3/1966 | Fender | |
| 8,283,542 | B2 | 10/2012 | Woodland et al. | |
| 10,395,627 | B2 * | 8/2019 | Colas | G10D 1/08 |
| 2005/0045018 | A1 * | 3/2005 | Turner | G10D 3/04 84/298 |

* cited by examiner

*Primary Examiner* — Kimberly R Lockett
(74) *Attorney, Agent, or Firm* — Hovey Williams LLP

(57) ABSTRACT

Described herein is an adjustable bridge unit for use with a stringed instrument, such as an electric guitar. The construction of the unit allows for an unimpeded string path from the rear of an adjustable height bridge in a downward trajectory toward a tailpiece. Moreover, the bridge unit may be used to convert a pivot style bridge system to a fixed bridge system, as well as to perform a variety of corrective measures, such as post placement, intonation, and string alignment, which may be required given discrepancies in manufacturing tolerances of the stringed instrument.

23 Claims, 7 Drawing Sheets

ADJUSTABLE BRIDGE FOR STRINGED INSTRUMENT DEVICE AND METHOD

CROSS-REFERENCE TO RELATED APPLICATIONS

The present application claims the priority benefit of U.S. Provisional Patent Application Ser. No. 63/085,245, filed Sep. 30, 2020, entitled ADJUSTABLE BRIDGE FOR STRINGED INSTRUMENT DEVICE AND METHOD, incorporated by reference in its entirety herein.

BACKGROUND OF THE INVENTION

Field of the Invention

The present invention is directed to an adjustable bridge for a stringed instrument. More particularly, embodiments of the invention relate to an adjustable bridge construction that allows for an unimpeded string path from the bridge to tailpiece, while allowing the ability and ease of intonation for each individual string. This construction addresses historic stability, intonation, and alignment issues with the traditional bridge designs.

Description of Related Art

The electric guitar has been a popular instrument for the last seven decades. Many of the most popular designs today are those that were created in the 1950s. As styles of music, gauges of strings, and manufacturing technologies have changed, many of the components of these original designs no longer yield optimal performance. An entire industry of aftermarket, direct fit replacement components has developed that address age old inadequacies of the original designs.

One such original design is a "floating" bridge, as described in U.S. Pat. No. 2,972,923, that is used in tandem with a separate vibrato/tailpiece. A similar bridge is described in U.S. Pat. No. 3,241,418. The lighter gauge strings used by players today results in minimized downward pressure exerted on the individual string saddles. Additionally, modern playing styles are more aggressive and exert more unwanted side to side tension on the string/saddle contact point. These two realties combine and exacerbate the historic flaws of this particular design, namely the outside saddles moving out of alignment and strings releasing from their saddle slots, thus throwing the instrument out of tune.

Guitarists have used a variety of remedies to increase the downward tension of the strings on the saddles. These include raising the adjustable bridge to a height that renders the guitar difficult to play, which is followed by shimming the neck angle to bring the instrument back into playability. There are also aftermarket tailpieces that create a steeper angle behind the bridge providing more downward tension at the strings contact point on the saddle. However, this creates an additional problem, as the strings then often make contact with the back of the bridge base creating an added friction point that inhibits the effective use of the vibrato by disrupting the smooth pivoting motion required for tuning stability. It also further inhibits access to the individual intonation adjustment screws of the individual string saddles. Also, this contact of the string against the back of the bridge base creates an unwanted audible vibratory point.

More recently, U.S. Pat. No. 8,283,542 addresses some of these concerns with a bridge that has two compensated saddles that are adjusted by means of four "intonation" screws. However, this method is unable to truly adjust the intonation requirements of each individual string. A multi string saddle design such as this, with each saddle housing slots for three strings, can only accurately intonate two of the strings given its design. The third string will just be an approximation, a compensated tuning. In some instances, the third string will be so noticeably out of tune to the average ear that it needs to be brought close to pitch by adjustments that render one of the other formerly intonated strings slightly out of intonation as well. The multitude of string gauges, wound and unwound string options, and alternate tunings that guitarist employ demand different intonation points for each string and will not lend themselves to a compensated saddles system.

Another historic issue with the original designs is that for many users the pivoting action of the bridge is undesirable. Often users with certain set up requirements for given styles of playing look for a means of stabilizing the pivoting action, in effect converting the pivoting or "rocking" bridge into a fixed unit.

Further, when applying a stabilization correction with, for instance, a nylon sleeve that makes for a tight fit, the exact location of the bridge thimbles that the post rest in is imperative. A 0.020" displacement of either thimble one direction or another is enough to set the placement out of the bounds of possibility for these makeshift solutions. As this is within the margin of error of many manufacturers, a better solution is required.

Another historic problem, which to date remains unaddressed, is that over the many years of guitar production, bridge locations have changed. While these changes are subtle, when combined with modern light gauge strings, which require a different intonation point as intonation is dictated by the core diameter of the string, they nonetheless create a reality that certain instruments are not able to be correctly intonated given the narrow field of travel that is allowed for the intonation saddles by the tight geometry of the original designs.

SUMMARY OF THE INVENTION

In one embodiment of the present invention, there is provided a bridge for a stringed instrument comprising an elongated base piece housing a plurality of saddles for supporting instrument strings, a pair of posts extending from a bottom side of the base piece and configured to at least partially reside within corresponding bores formed in a body portion of the stringed instrument, and a pair of collars rotatably coupled around the posts and configured to contact a surface within the corresponding bores. In one embodiment, there is provided a method of installing the bridge onto the stringed instrument comprises inserting the pair of posts into the corresponding bores formed in the body portion of the stringed instrument such that the pair of collars contact a surface within the corresponding bores so as to restrict movement of the bridge on the stringed instrument. In one embodiment, there is provided a stringed instrument comprising the bridge installed thereon.

In one embodiment of the present invention, there is provided a bridge for a stringed instrument comprising an elongated base piece comprising a front plate and a rear plate defining a channel therebetween, a plurality of string saddles residing within the channel, each of the plurality of string saddles comprising a centrally positioned string seat and a pair of side segments, at least one of the side segments on each of the string saddles comprising a screw hole formed therethrough that is positioned laterally offset from the string seat, and a plurality of intonation screws, each of the plurality of intonation screws passing through a corresponding opening in the front plate and/or rear plate and threadedly coupled with and through the offset screw hole of one of the string saddles. In one embodiment, there is provided a stringed instrument comprising the bridge installed thereon.

In one embodiment of the present invention, there is provided a bridge for a stringed instrument with six barrel saddles, wherein each saddle comprises an adjustment screw to set the intonation for its specific string.

In one embodiment of the present invention, there is provided a bridge for a stringed instrument, wherein each intonation screw is offset to the side from the barrel saddle center so as to provide access for an adjustment tool and to allow clearance for the strings to pass at a steeper angle behind the bridge.

In one embodiment of the present invention, there is provided a bridge for a stringed instrument, wherein each intonation adjustment screw hole is drilled in the lower quadrant of the saddle barrel such that the screw hole is closer to the bottom of the bridge base, thereby providing greater clearance for the strings.

In one embodiment of the present invention, there is provided a bridge for a stringed instrument with the two outermost saddles having additional material on the side distal from the saddle center, thereby providing the structural integrity required to drill the intonation screw hole completely out of the path of the string line, as these outside strings have a path alignment that follows the edges of the fingerboard radius which are the lowest points, thus requiring greater clearance.

In one embodiment of the present invention, there is provided a bridge for a stringed instrument, wherein the added material/saddle extensions on the outside of the two saddles furthest from center feature a smaller diameter than the rest of the saddle in order to allow clearance for the two button head screw or slagged/flange press-fit post attachments that are located slightly above the surface of the bridge plate in the very tight geometry that is common in the original designs.

In one embodiment of the present invention, there is provided a bridge for a stringed instrument, wherein a plurality of holes/openings on both sides of the bridge plate allow for both insertion of the intonation screws from the rear and a through hole in the front of the plate, which allows the screw to anchor itself, thus preventing side to side movement.

In one embodiment of the present invention, there is provided a bridge for a stringed instrument, wherein the bridge plate comprises a plurality of slots machined into the rear of the plate along each string line providing additional clearance to accommodate the steepest of angles required for the strings to pass unimpeded on their path to the instrument tailpiece.

In one embodiment of the present invention, there is provided a bridge for a stringed instrument, wherein the bridge base can be supported in the traditional manner by two posts which allow for raising and lowering the entire system by use of a pair of internal access height adjustment screws. The bridge may further include an external threaded post that accepts a larger diameter collar.

In one embodiment of the present invention, there is provided a bridge for a stringed instrument comprising a collar, which is rotatably coupled with each post, enlarging the diameter of the post and converting from a pivot style to a fixed bridge system.

In one embodiment of the present invention, there is provided a bridge for a stringed instrument, wherein the inner diameter of the collar can be tapped from a centrally located hole through the collar or through a hole that is offset from the center of the collar, depending on application needs.

DETAILED DESCRIPTION

The present invention is concerned with an adjustable bridge for a stringed instrument. The adjustable bridge may advantageously be retrofit into an instrument having an existing standard bridge design, or the adjustable bridge may be installed during construction of the stringed instrument.

Figure 6:
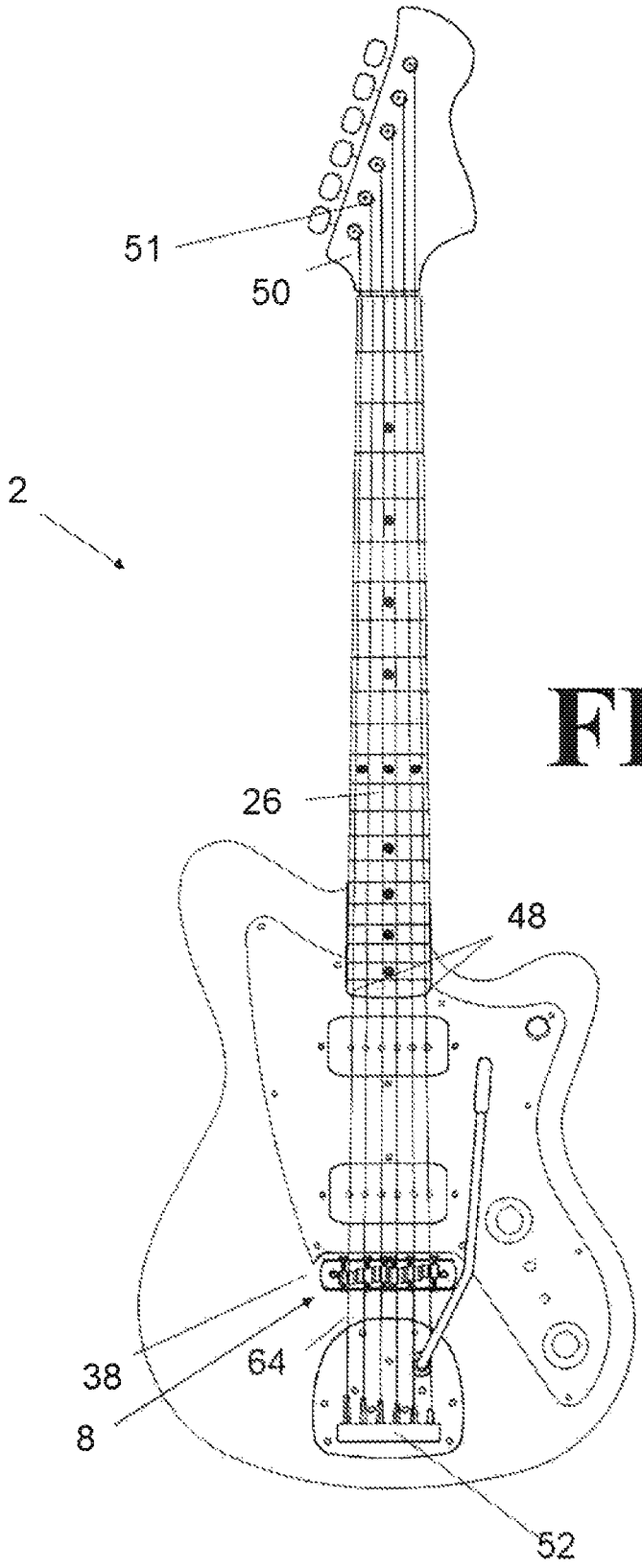
FIG. 6 is a top view of an electric guitar comprising a bridge unit installed thereon, according to one embodiment of the present invention.

As shown in FIG. 6, the stringed instrument 2 may be a six-string electric guitar. However, it will be understood that the adjustable bridge described herein may also be used in conjunction with other stringed instruments, both electric and acoustic, and with any number of strings. Stringed instrument 2 generally comprises a body 38, a fingerboard (or neck) 26, a headstock 50, and a plurality of strings 64 each defining a string path between the body 38 and headstock 50. In particular, each of the plurality of strings 64 is attached at one end to a tailpiece 52 within the body 38 and at the other end to a tuning peg 51 within the headstock 50. The strings 64 are lifted and supported off of the body 38 and fingerboard 26 by a bridge 8, thereby allowing the strings 64 to be tuned and played as desired by a user.

Referring now to FIGS. 1-5, a bridge 8 is shown and described below. The bridge 8 generally comprises an elongated base piece 10 housing a plurality of individual string saddles 12 configured to support individual strings 64. The base piece 10 comprises a front plate 65 and rear plate 66 defining a generally U-shaped channel therebetween, in which the string saddles 12 at least partially reside. Each of the string saddles 12 has a corresponding dedicated intonation screw 14, which is used for adjusting the position of the string saddle within the channel.

Figure 1:
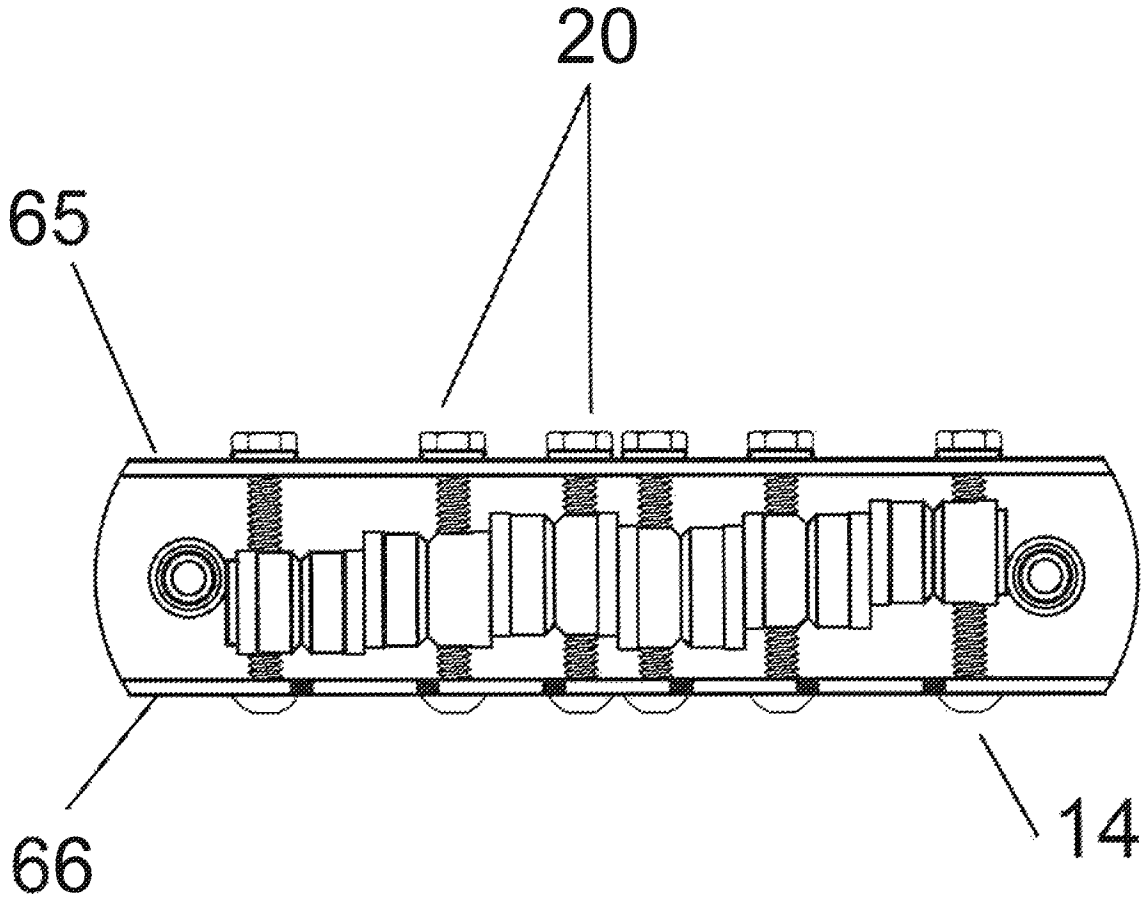
FIG. 1 is a top view of a bridge unit according to one embodiment of the present invention.
Figure 2:
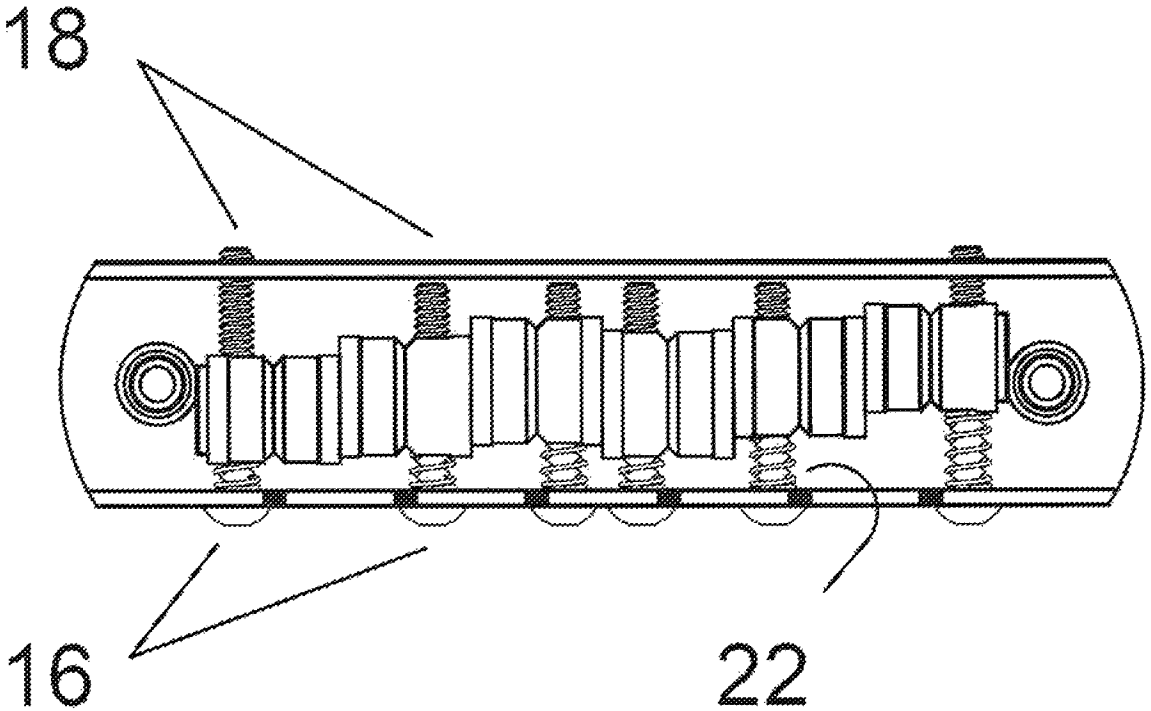
FIG. 2 is a top view of a bridge unit according to another embodiment of the present invention.

As shown in FIG. 1, in certain embodiments, intonation screws 14 pass through the rear openings 16 formed in rear plate 66, thread through the individual saddles 12, and continue through the front openings 18 formed in front plate 65. In certain embodiments, the openings 16, 18 are spaced apart in irregular intervals across the front plate 65 and/or rear plate 66, which accommodates offset positioning of the intonation screws 14 relative to the saddles 12, as described in greater detail below. In certain embodiments, the intonation screws 14 may be anchored to the front plate 65 with locking nuts 20, and each barrel saddle 12 may be individually adjusted with twisting of the dedicated screw 14. As shown in FIG. 2, in alternative embodiments, each saddle 12 may be held firmly in place by a compression spring 22 positioned around the dedicated intonation screw 14 between the rear of the saddle 12 and the interior surface of rear plate 66. Alternatively, the intonation screws 14 may be held in place with C-rings. Regardless, in certain embodiments, each intonation screw 14 may be threadedly coupled with a screw hole in a corresponding string saddle 12, such that adjustment of the saddles 12 generally occurs by twisting of the intonation screw 14.

Figure 3:
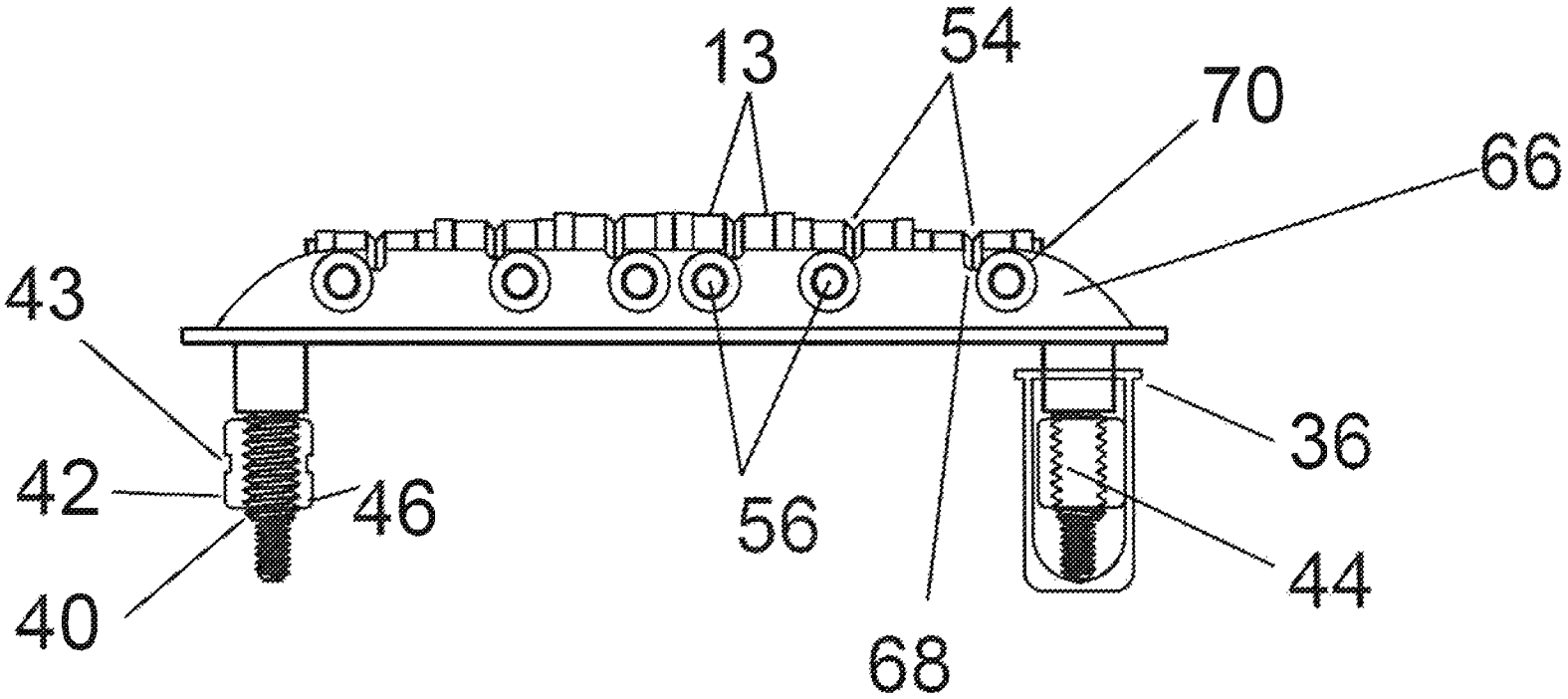
FIG. 3 is a rear view of a bridge unit according to one embodiment of the present invention, wherein certain portions of the bridge unit are cut away to illustrate internal details of the unit.
Figure 4:
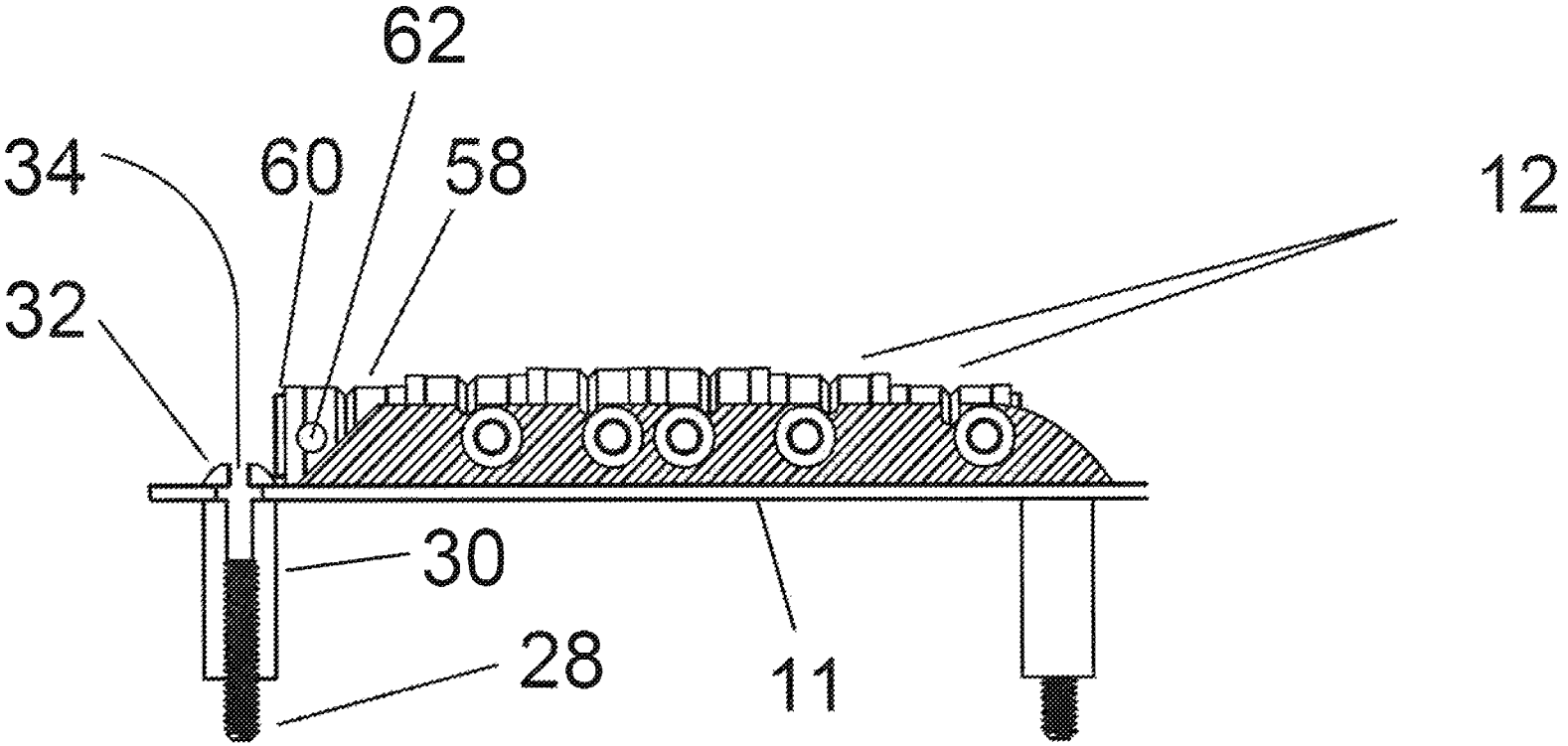
FIG. 4 is a rear view of a bridge unit according to one embodiment of the present invention, wherein certain portions of the bridge unit are cut away to illustrate internal details of the unit.
Figure 5:
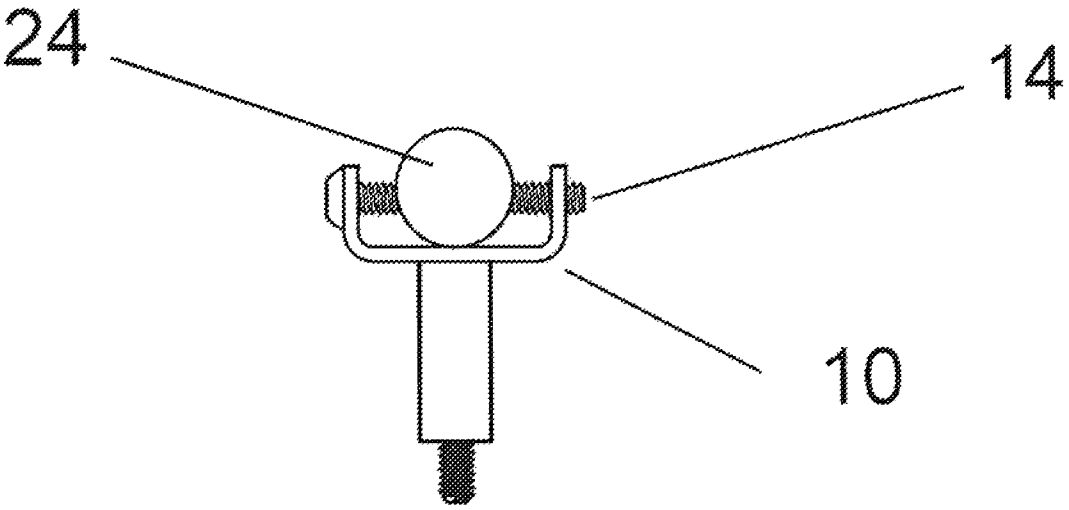
FIG. 5 is a side view of a bridge unit according to one embodiment of the present invention.

String saddles 12 may be any of a variety of designs, having a variety of geometries and sizes. However, as shown in FIGS. 1-5, in certain embodiments the string saddles 12 may be barrel style saddles, which have a generally cylindrical shape. A seat 54 may be formed in a center plane of the saddle 12, dividing the saddle into two side segments 13, and upon which an instrument string 64 may be supported and/or held in place. For example, seat 54 may comprise a radii milled into the saddle 12 to facilitate seating of the string. As best shown in FIGS. 3 and 4, the barrel saddle diameters may have differing sizes to match the placement of each string to the overall radius of the fingerboard 26.

In certain embodiments, each intonation screw 14 may be offset from the center plane (or seat 54) to either side segment 13 of the respective barrel saddle 12. Thus, at least one of the side segments 13 on each of the string saddles 12 comprises a screw hole 62 formed therethrough that is positioned laterally offset from the string seat 54. The offset configuration positions the intonation screws 14 such that they are not directly underneath the instrument strings, thereby providing easier access to use an adjustment tool to twist the intonation screws 14. This configuration also allows clearance for the strings 64 to pass at a steeper angle behind the bridge 8 toward the tailpiece 52. Thus, in certain embodiments, the intonation screws 14 are offset as far outside of the string paths as mechanically possible. In certain embodiments, the laterally offset screw holes 62 extend predominantly through a lower portion (i.e., closer to the base piece of a side segment 13 (which may be considered a lower quadrant of the barrel saddle 12), which further reduces interference of the string 64 path to the tailpiece 52.

In certain embodiments, the plurality of string saddles 12 comprises one or more interior string saddles 12 and a pair of outermost string saddles 58 positioned at opposite distal ends of the elongated base piece 10. The two outermost string saddles 58 may each comprise an extended segment 58 on the outermost side segment 13 (i.e., the side furthest from the centerline of the instrument). In such embodiments, the offset screw holes 62 of the outermost string saddles 58 are offset from the string path and string seat 54 by a greater distance than the offset screw holes 62 formed in the one or more interior string saddles 12. As shown, in certain embodiments, the diameter of extended segment 60 may be smaller than the diameter of the side segments of the barrel style saddle 12. The smaller diameter allows for the necessary clearance of the post mechanism (described below) that resides above the plane of the base piece 10 but also maintains the structural integrity required for the intonation screw 14 to extend through the hole 62.

Bridge 8 may comprise one or more additional features that allow for improved string clearance. In certain embodiments, the rear plate 66 is milled as low as possible (i.e., just to the tops of the intonation screwhead line 70. Thus, the openings 16 in rear plate 66 may be formed predominantly in an upper portion of rear plate 66 (i.e., farther from base piece 10). In certain embodiments, rear plate 66 may comprise a plurality of notches or channels 68 formed therein. The notches 68 may be formed in regularly spaced intervals across rear plate 66, and can be aligned with string seats 54 and/or offset from the intonation screws 14. Such features can advantageously allow the strings to pass unimpeded and at steeper angles toward the tail piece 52.

Reference is made below to FIGS. 3 and 4, which show different cut away views of an exemplary bridge 8 so as to better illustrate certain features described herein. It should be understood, however, that features illustrated in FIG. 3 can be used in combination with features illustrated in FIG. 4 (and vice versa) within embodiments of the present invention.

Figure 7:
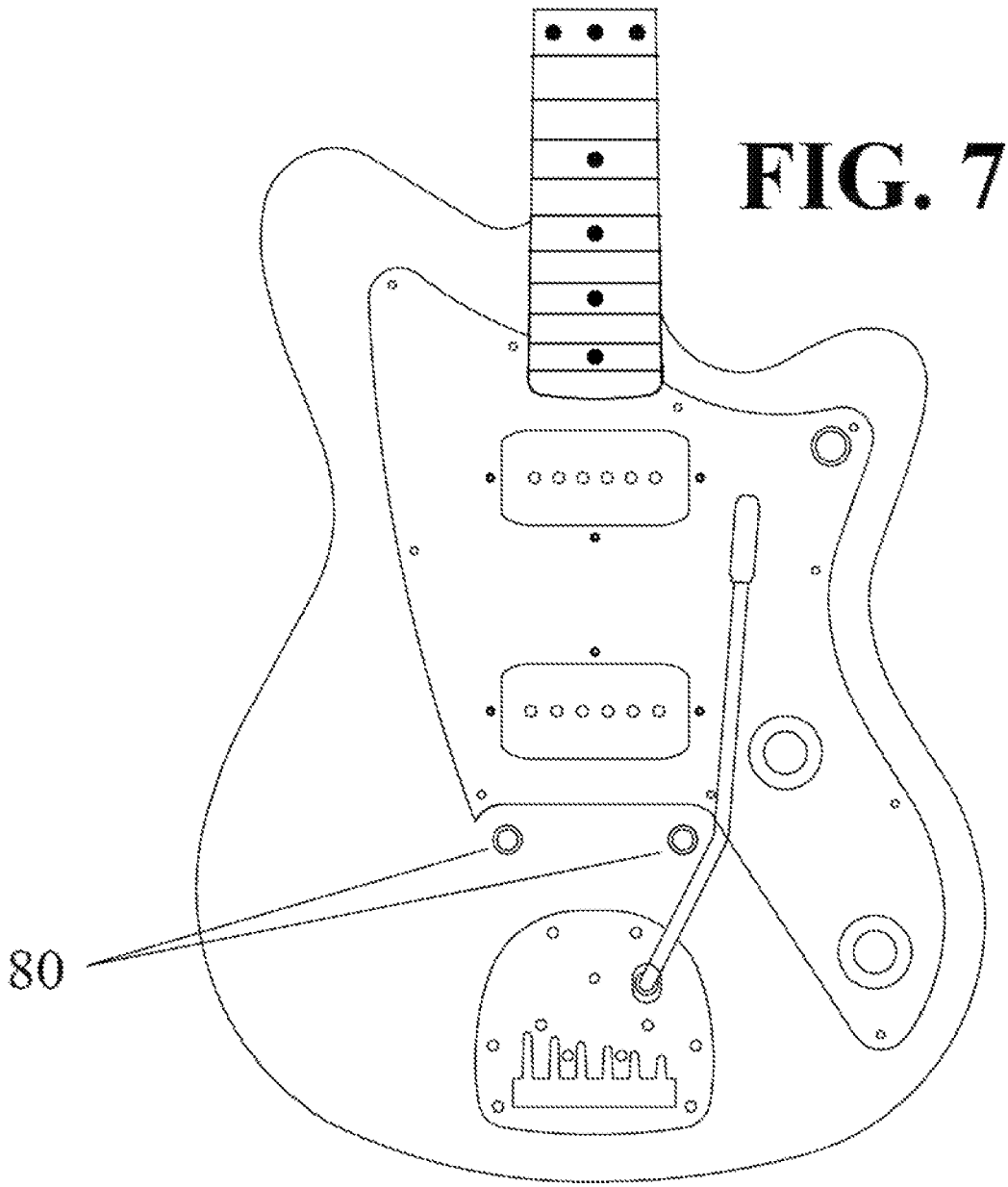
FIG. 7 is a top view of the electric guitar of FIG. 6 without the bridge unit installed thereon.

In certain same or other embodiments, bridge 8 comprises a pair of posts 30 extending from a bottom side 11 of the base piece 10. When installed on a stringed instrument 2, the posts extend into and at least partially reside within corresponding bores 80 (FIG. 7) formed in the body 38 of the stringed instrument 2. As best shown in FIG. 4, in certain embodiments, the pair of posts 30 can be positioned proximate to opposing distal ends of the elongated base piece 10. The posts may be affixed to the base piece 10 by a variety of mechanisms, such as a screwed, braised, press-fit or flanged attachment 32. In certain embodiments, each of the posts 30 may comprise an interior threaded portion configured to be threadedly coupled to corresponding height adjustment screws 28 secured within the bores 80. The overall string height of the bridge 8 may be adjusted using the height adjustment screws 28, which may be accessed via a hole 34 that opens into the threaded post 30.

As best shown in FIG. 3, in certain embodiments, a pair of adaptor collars 42 are rotatably coupled around the posts 30. In certain embodiments, the collars 42 comprise a substantially cylindrical outer geometry, although other geometries, such as hex, elliptic cylinder, etc., may also be used that impart the same or similar functionality as described below. In certain embodiments, the collars 42 may comprise an indented portion 43 formed in the outer geometry, which allows for a wrench or other tool to be used to rotate the collars 42 about the posts 30. When installed in the stringed instrument, the collars 42 contact a surface within the corresponding bores 80, thereby restricting movement of the posts 30 within the bores 80 and the movement of the bridge 8 on the stringed instrument 2.

In certain embodiments, the collars 42 comprise a center axis and an inner diameter offset from the center axis, such that rotating the collars 42 around the posts 30 changes the alignment of the collars 42 on the posts 30. Thus, when installed on a stringed instrument 2, the position of the bridge 8 on the stringed instrument 2 is also changed by rotating the collars 42. In certain embodiments, the collars 42 may be rotated in tandem to correct for poor neck to bridge alignment. For example, in certain embodiments, rotating the collars 42 toward each other or away from each other allows for correction of a wider or narrower insert placement (described below) due to manufacturing irregularities. Additionally, rotating both collars the same direction can shift the entire bridge assembly left or right to fine tune sting alignment along the fingerboard of an instrument 48 which is also subject to +/−tolerances in production. Likewise, once set for alignment, the collars 42 can be rotated 180 degrees to shift the bridge 8 toward the headstock 50 or towards the tailpiece 52 to allow further travel of the intonation saddles 12 in one direction or another. This is particularly advantageous given changes in location of inserts (described below) over the last sixty years of guitar production.

In certain embodiments, the posts 30 and collars 42 are rotatably and threadedly coupled. For example, as best shown in FIG. 3, the posts 30 may comprise an exterior threaded (male) portion 40 threadedly coupled to in interior threaded (female) portion 44 of the inner diameter of the collars 42. As noted above, the threaded portion 44 of the inner diameter can be offset from the center axis of the collar 42, allowing for a user to twist/screw the collar 42 in either direction to facilitate centering of the bridge 8 and string alignment.

Embodiments of the present invention are also directed to methods of installing the bridge 8 onto a stringed instrument 2. The method generally comprises inserting the posts 30 into corresponding bores 80 formed in the body 38 of the stringed instrument 2. In certain embodiments, the pair collars 42 coupled with the posts 30 contact a surface within the corresponding bores 80, thereby restricting movement of the bridge 8. In this way, the bridge may be converted from a traditional "pivot" system to a fixed bridge system.

As best shown in FIG. 3, upon installation, the two posts 30 may sit in hollowed cup-shaped inserts (or thimbles) 36, which may be press fit into the bores 80 formed in the body 38 of instrument 2. In certain such embodiments, the posts 30 may pivot within the inserts 36, for example with the action of a vibrato, or the posts 30 may be seated firmly for non-pivoting purposes. When the cup-shaped inserts 36 are present, the collar 42 may contact a surface of the insert 36, thereby restricting movement of the post 30 within the insert 36 and the bridge 8 on the instrument body 38.

Additional advantages of the various embodiments of the invention will be apparent to those skilled in the art upon review of the disclosure herein and the working examples below. It will be appreciated that the various embodiments described herein are not necessarily mutually exclusive unless otherwise indicated herein. For example, a feature described or depicted in one embodiment may also be included in other embodiments, but is not necessarily included. Thus, the present invention encompasses a variety of combinations and/or integrations of the specific embodiments described herein.

As used herein, the phrase "and/or," when used in a list of two or more items, means that any one of the listed items can be employed by itself or any combination of two or more of the listed items can be employed. For example, if a structure is described as containing or excluding components A, B, and/or C, the structure can contain or exclude A alone; B alone; C alone; A and B in combination; A and C in combination; B and C in combination; or A, B, and C in combination.

I claim:

1. A bridge for a stringed instrument comprising:

an elongated base piece housing a plurality of saddles for supporting instrument strings;

a pair of posts extending from a bottom side of the base piece and configured to at least partially reside within corresponding bores formed in a body portion of the stringed instrument;

a pair of collars rotatably coupled around the posts and configured to contact a surface within the corresponding bores, thereby restricting movement of the posts within the bores and the movement of the bridge on the stringed instrument.

2. The bridge of claim 1, wherein each of the collars comprises a center axis and an inner diameter offset from the center axis.

3. The bridge of claim 2, wherein the collars comprise a substantially cylindrical outer geometry.

4. The bridge of claim 3, wherein the collars comprise an indented portion formed in the substantially cylindrical outer geometry.

5. The bridge of claim 2, wherein the inner diameter of each of the collars comprises an interior threaded portion, wherein each of the posts comprises an exterior threaded portion, and wherein the interior threaded portion of the collars are rotatably and threadedly coupled to the exterior threaded portion of the posts.

6. The bridge of claim 1, wherein the pair of posts are positioned proximate to opposing ends of the elongated base piece.

7. The bridge of claim 1, wherein each of the posts comprise an interior threaded portion configured to be threadedly coupled to corresponding height adjustment screws secured within the bores.

8. A method of installing the bridge of claim 1 onto a stringed instrument, the method comprising inserting the pair of posts into the corresponding bores formed in the body portion of the stringed instrument such that the pair of collars contact a surface within the corresponding bores so as to restrict movement of the bridge on the stringed instrument.

9. The method of claim 8, wherein each of the bores comprises a cup-shaped insert installed therein, and wherein each of the pair of collars contacts a surface of the cup-shaped insert.

10. The method of claim 8, further comprising first removing an existing pivot bridge from the stringed instrument and subsequently installing the bridge of claim 1 onto the stringed instrument, thereby converting the stringed instrument from a pivot bridge system to a fixed bridge system.

11. A stringed instrument comprising the bridge of claim 1 installed thereon.

12. A bridge for a stringed instrument comprising:

an elongated base piece comprising a front plate and a rear plate defining a channel therebetween;

a plurality of barrel style string saddles residing within the channel, each of the plurality of string saddles comprising a centrally positioned string seat and a pair of side segments, at least one of the side segments on each of the string saddles comprising a screw hole formed therethrough that is positioned laterally offset from the string seat and extends predominantly through a lower portion of the side segment; and a plurality of intonation screws, each of the plurality of intonation screws passing through a corresponding opening in the front plate and/or rear plate and threadedly coupled with and through the offset screw hole of one of the string saddles.

13. The bridge of claim 12, wherein the screw hole formed in the string saddles extends predominantly through a lower portion of the side segment.

14. The bridge of claim 12, wherein the openings are spaced apart in irregular intervals across the front plate and/or rear plate.

15. The bridge of claim 12, further comprising a compression spring positioned around each of the intonation screws and between the corresponding string saddle and the front plate or the rear plate.

16. The bridge of claim 12, wherein the openings are formed in both the front plate and the rear plate, and wherein each of the intonation screws passes through the corresponding openings in both the front plate and the rear plate.

17. The bridge of claim 16, wherein each of the intonation screws further comprises a screw head and a locking nut securing the intonation screws to the front plate and rear plate of the base piece.

18. The bridge of claim 12, wherein the plurality of string saddles comprises one or more interior string saddles and a pair of outermost string saddles positioned at opposite distal ends of the elongated base piece, wherein each of the outermost string saddles comprises an outermost side segment comprising an extended segment, and wherein the offset screw holes formed in the outermost string saddles are offset from the string seat by a greater distance than the offset screw holes formed in the one or more interior string saddles.

19. The bridge of claim 12, wherein base piece comprises a plurality of notches formed in an upper edge of the rear plate at regularly spaced intervals and offset from the plurality of intonation screws string clearance notches cut in rear of base plate.

20. A stringed instrument comprising the bridge of claim 12 installed thereon.

21. A bridge for a stringed instrument comprising:

an elongated base piece housing a plurality of saddles for supporting instrument strings;

a pair of posts extending from a bottom side of the base piece and configured to at least partially reside within corresponding bores formed in a body portion of the stringed instrument;

a pair of collars rotatably coupled around the posts and configured to contact a surface within the corresponding bores, wherein each of the collars comprises a center axis and an inner diameter offset from the center axis.

22. A bridge for a stringed instrument comprising:

an elongated base piece comprising a front plate and a rear plate defining a channel therebetween;

a plurality of string saddles residing within the channel, each of the plurality of string saddles comprising a centrally positioned string seat and a pair of side segments, at least one of the side segments on each of the string saddles comprising a screw hole formed therethrough that is positioned laterally offset from the string seat;

a plurality of intonation screws, each of the plurality of intonation screws passing through a corresponding opening in the front plate and/or rear plate and threadedly coupled with and through the offset screw hole of one of the string saddles; and a compression spring positioned around each of the intonation screws and between the corresponding string saddle and the front plate or the rear plate.

23. A bridge for a stringed instrument comprising:

an elongated base piece comprising a front plate and a rear plate defining a channel therebetween;

a plurality of string saddles residing within the channel, each of the plurality of string saddles comprising a centrally positioned string seat and a pair of side segments, at least one of the side segments on each of the string saddles comprising a screw hole formed therethrough that is positioned laterally offset from the string seat; and a plurality of intonation screws, each of the plurality of intonation screws passing through a corresponding opening in the front plate and/or rear plate and threadedly coupled with and through the offset screw hole of one of the string saddles, wherein the plurality of string saddles comprises one or more interior string saddles and a pair of outermost string saddles positioned at opposite distal ends of the elongated base piece, wherein each of the outermost string saddles comprises an outermost side segment comprising an extended segment, and wherein the offset screw holes formed in the outermost string saddles are offset from the string seat by a greater distance than the offset screw holes formed in the one or more interior string saddles.

* * * * *